US009114948B2

(12) United States Patent
Niioka et al.

(10) Patent No.: US 9,114,948 B2
(45) Date of Patent: Aug. 25, 2015

(54) DETERMINATION DEVICE, PRINTING APPARATUS AND DETERMINATION METHOD

(71) Applicant: Seiko Epson Corporation, Tokyo (JP)

(72) Inventors: Koji Niioka, Tatsuno-machi (JP); Hideo Uruma, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 127 days.

(21) Appl. No.: 13/796,334

(22) Filed: Mar. 12, 2013

(65) Prior Publication Data

US 2013/0233961 A1 Sep. 12, 2013

(30) Foreign Application Priority Data

Mar. 12, 2012 (JP) ..... 2012-054893

(51) Int. Cl.
*B65H 26/00* (2006.01)
*B65H 16/10* (2006.01)

(52) U.S. Cl.
CPC ..... *B65H 16/103* (2013.01); *B65H 16/10* (2013.01); *B65H 26/00* (2013.01); *B65H 2403/942* (2013.01)

(58) Field of Classification Search
CPC ..... B65H 26/00
USPC ..... 242/534–534.2, 563, 563.2, 413, 413.1, 242/413.9
See application file for complete search history.

(56) References Cited

U.S. PATENT DOCUMENTS

| | | | | |
|---|---|---|---|---|
| 3,912,193 | A * | 10/1975 | Calvaer | 242/534.1 |
| 4,500,045 | A * | 2/1985 | Whitaker et al. | 242/534.1 |
| 5,299,751 | A * | 4/1994 | Pichlmair et al. | 242/571 |
| 8,002,214 | B2 | 8/2011 | Genta et al. | |
| 8,147,023 | B2 | 4/2012 | Hatada et al. | |
| 8,328,318 | B2 * | 12/2012 | Igarashi et al. | 347/16 |
| 8,419,154 | B2 * | 4/2013 | Igarashi et al. | 347/16 |
| 2009/0245912 | A1 * | 10/2009 | Igarashi et al. | 400/618 |
| 2010/0053251 | A1 * | 3/2010 | Igarashi et al. | 347/16 |

FOREIGN PATENT DOCUMENTS

| | | | |
|---|---|---|---|
| JP | 2007-290866 | A | 11/2007 |
| JP | 2009-242048 | A | 10/2009 |
| JP | 2009-255496 | A | 11/2009 |
| JP | 2009-256095 | A | 11/2009 |
| JP | 2009-280398 | A | 12/2009 |
| JP | 2010-052379 | A | 3/2010 |

* cited by examiner

*Primary Examiner* — Sang Kim
(74) *Attorney, Agent, or Firm* — Nutter McClennen & Fish LLP; John J. Penny, Jr.; Joshua I. Rudawitz

(57) ABSTRACT

A determination device that determines the mounted state of the roll body on which the medium is wound in a roll shape, includes a roll motor that rotates a rotating member on which the roll body is mounted; a transportation roller that transports the medium fed from the roll body, in a transportation direction; a storage unit that stores information which is capable of specifying a pulling-out direction of the roll body mounted on the rotating member; a sensor that detects a rotation of the transportation roller; and a determination unit that detects whether or not the roll body corresponding to the information is mounted normally. The determination unit determines that the roll body is not mounted normally, in a case where the sensor detects the rotation of the transportation roller is rotating, when the roll motor is rotated in a direction corresponding to the pulling-out direction.

9 Claims, 10 Drawing Sheets

DETERMINATION DEVICE, PRINTING APPARATUS AND DETERMINATION METHOD

CROSS-REFERENCE TO RELATED APPLICATIONS

The entire disclosure of Japanese Patent Application No. 2012-054893, filed Mar. 12, 2012 is expressly incorporated by reference herein.

BACKGROUND

1. Technical Field

The present invention relates to a determination device, a printing apparatus and a determination method.

2. Related Art

An ink jet printer forming an image on a medium by means of ejecting an ink on the medium is in practical use. Among such printing apparatuses, there is a printing apparatus in which a sheet is continuously fed from a roll sheet as a printing medium.

In JP-A-2009-255496, a method for obtaining a diameter of a roll body is disclosed. In JP-A-2007-290866, a method for simply applying a back-tension corresponding to a roll-shaped medium in use, is disclosed.

In JP-A-2009-242048, a method for preventing variations in a tension regardless of using the roll body or not, is disclosed. In JP-A-2010-52379, in at least a part of period when a second motor that intermittently drives a transportation drive roller stops driving, in order to effectively stabilize a transportation of the roll sheet, a method for stopping the driving of a first motor which rotates the roll sheet, is disclosed.

In JP-A-2009-256095, a method is disclosed in which a motor control is performed so that a tensile force between the roll body and the transportation drive roller is equal to or less than a predetermined value.

In JP-A-2009-280398, a method is disclosed in which a problem slack in the medium occurring between the roll body and the transportation drive roller is solved by driving at least one of the first motor and the second motor.

In a roll body such as a roll sheet, there are two types of roll bodies, an outward winding roll in which an outer side is a printing surface and an inward winding roll in which an inner side is a printing surface. Since there is such a difference in the printing surface, a printing apparatus needs to preset any roll body to be used. The printing apparatus rotates the roll body and feeds the medium such as a sheet depending on the pre-set type of the roll body.

However, if the roll body is mounted in the wrong direction, the printing apparatus rotates the roll body in a rewinding direction rather than in a direction to which the medium is fed. That is, it may not be possible to properly feed the medium from the roll body. When the medium may not be properly fed, there has been a problem in that the ink continuously ejected on a specific region of the medium causes degraded image forming in quality. Accordingly, it is desirable to properly determine the mounted state of the roll body before printing.

SUMMARY

An advantage of some aspects of the invention is to properly determine a mounted state of a roll body.

According to an aspect of the invention, there is provided a determination device that determines the mounted state of the roll body on which the medium is wound in a roll shape, including: a roll motor that rotates a rotating member on which the roll body is mounted, a transportation roller that transports the medium fed from the roll body, in a transportation direction, a storage unit that stores information which is capable of specifying a pulling-out direction of the roll body mounted on the rotating member, a sensor that detects a rotation of the transportation roller, and a determination unit that detects whether or not the roll body corresponding to the information is normally mounted. The determination unit determines that the roll body is not mounted normally, in a case where the sensor detects the rotation of the transportation roller, when the roll motor is rotated in a direction corresponding to the pulling-out direction which is specified based on the information stored in the storage unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
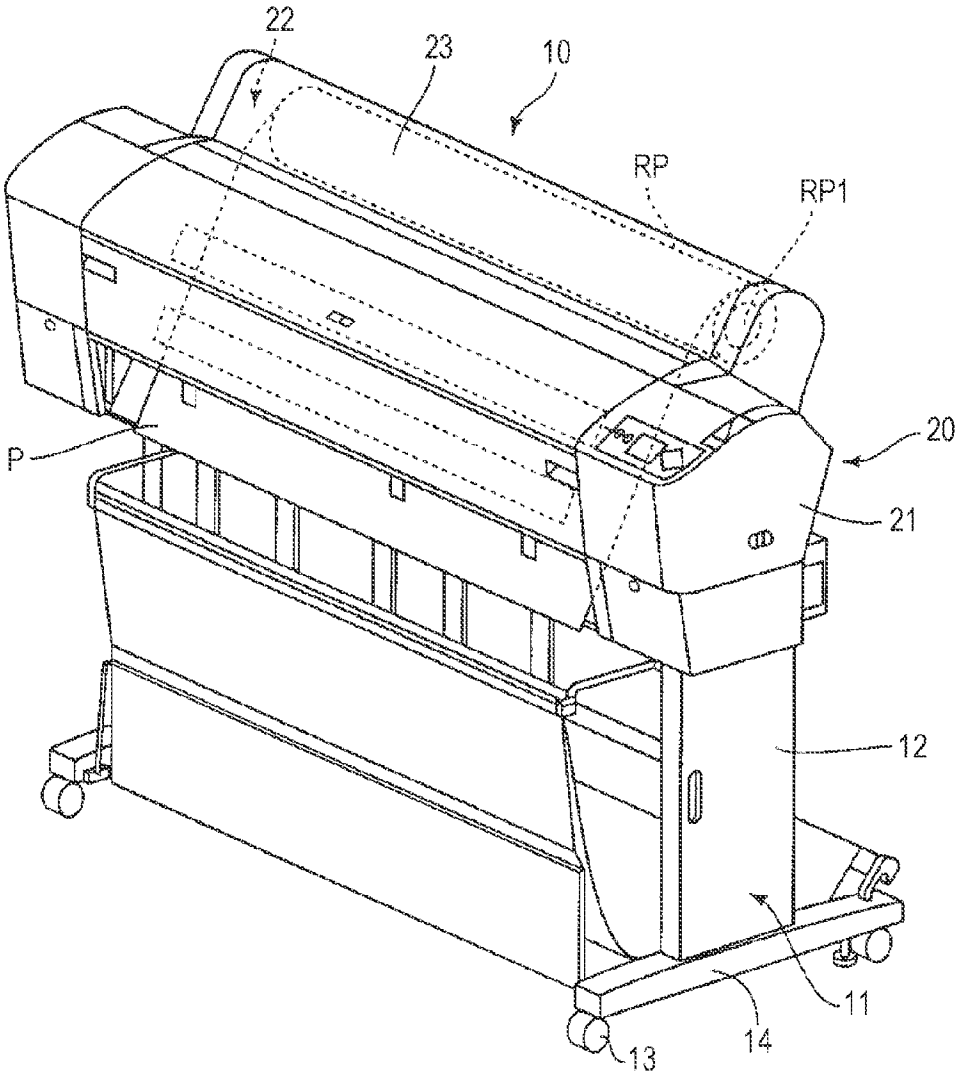
FIG. 1 is a diagram illustrating an example of an external configuration of a printer according to the embodiment.

According to an aspect of the invention, there is provided a determination device that determines the mounted state of the roll body on which the medium is wound in a roll shape, including: a roll motor that rotates a rotating member on which the roll body is mounted, a transportation roller that transports the medium fed from the roll body in a transportation direction, a storage unit that stores information which is capable of specifying a pulling-out direction of the roll body mounted on the rotating member, a sensor that detects a rotation of the transportation roller; and a determination unit that detects whether or not the roll body corresponding to the information is mounted normally. The determination unit determines that the roll body is not mounted normally, in a case where the sensor detects that the transportation roller is rotating, when the roll motor is rotated in a direction corresponding to the pulling-out direction which is specified based on the information stored in the storage unit.

If the roll body is mounted in a correct direction and the roll motor is rotated in a direction corresponding to the pulling-out direction, the pulled out medium is slack between the roll body and the transportation roller. On the other hand, when the roll body is mounted in the wrong direction and the roll motor is rotated in a direction corresponding to the pulling-out direction, the roll body is rotated in a rewinding direction of the medium. Then, the medium rotates the transportation roller in a reverse direction. Accordingly, by detecting the rotation of the transportation roller, it is possible to determine the mounting direction of the roll body. In other words, it is possible to properly determine the mounted state of the roll body.

In such a determination device, when the roll motor is driven in a direction corresponding to the pulling-out direction which is specified based on the information stored in the storage unit, in a case where the sensor detects that the transportation roller rotates in a reverse direction to the rotating direction where the transportation roller transports the medium in the transportation direction, it is desirable that the determination unit determines that the roll body is not mounted normally.

In this way, if the roll body is mounted in the wrong direction, the roll body rotates the medium in the rewinding direction, hence the transportation roller is rotated in the reverse rotating direction. Accordingly, in a case where the transportation roller rotates in a direction reverse to the positive rotating direction, it is possible to determine that the roll body is mounted in a second state. That is, it is possible to properly determine the mounting directions of a pair of rolls.

In addition, when the roll motor is driven in a direction corresponding to the pulling-out direction which is specified based on the information stored in the storage unit, in a case where the transportation roller rotates in the reverse direction by a predetermined amount or more, it is desirable that the determination unit determines that the roll body is not mounted normally.

In a case where the transportation roller rotates in the reverse direction and the rotation amount is small, there is a possibility that the roll body may be mounted in a first state. In such a case, it is possible to reduce an erroneous determination.

In addition, according to another aspect of the invention, there is provided the determination device including: a transportation motor that rotates the transportation roller, and a roll body rotation detection sensor that detects a rotation of the roll body. The detection unit detects a start drive force when the roll body starts rotating, by driving the roll motor to rotate the roll body after the roll body is mounted on the rotating member. When the transportation roller rotates by driving the transportation motor and the roll motor using a drive force lower than the start drive force, it is desirable for the determination unit to perform the determination in a case where the rotation of the roll body is not detected.

In this way, after detecting the start drive force when the roll body starts rotating, it is possible to perform a determination whether or not a subsequent determination of the mounting direction of the roll body will be performed, using the operations to remove the slack in the medium between the roll body and the transportation roller.

In addition, when the transportation roller rotates by driving the transportation motor and the roll motor using a drive force lower than the start drive force, it is desirable that the determination unit may not perform the determination in a case where the rotation of the roll body is detected.

In this way, it is possible not to perform the determination of the mounting direction of the roll body in a predetermined case, using the operations to remove the slack in the medium between the roll body and the transportation roller.

In addition, it is desirable that the detection of the start drive force, which is performed by driving the roll motor, is performed after the roll body is mounted on the rotating member and then the transportation drive roller is rotated to generate a tensile force between the roll body and the transportation roller.

In this way, it is possible to perform the detection of the start drive force described above, after the roll body is mounted on the rotating member and then the slack occurring between the roll body and the transportation roller is removed.

In addition, it is desirable that a drive force of the roll motor is higher than the drive force of the transportation motor.

In this way, even in a case where the roll body is mounted in the wrong direction, it is possible to properly determine the mounted state of the roll body by rotating the roll motor to rotate the transportation motor without any difficulty.

According to another aspect of the invention, there is provided the determination device including: a roll motor that rotates a rotating member on which the roll body is mounted, a transportation roller that transports the medium fed from the roll body in a transportation direction, a storage unit that stores information which is capable of specifying a pulling-out direction of the roll body mounted on the rotating member, a sensor that detects the rotation of the transportation roller; and a determination unit that detects whether or not the roll body corresponding to the information is mounted normally. The determination unit determines that the roll body is mounted normally, in a case where the sensor does not detect the rotation of the transportation roller, when the roll motor is rotated in a direction corresponding to the pulling-out direction which is specified based on the information stored in the storage unit.

If the roll body is mounted in the correct direction and the roll motor is rotated in the direction corresponding to the pulling-out direction, the pulled-out medium is slack between the roll body and the transportation roller, and thus the sensor does not detect the rotation of the transportation roller. Accordingly, it is possible to determine the mounting direction of the roll body. In other words, it is possible to properly determine the mounted state of the roll body.

In addition, the present description and the accompanying drawings allow at least the aspect to become apparent. That is, according to another aspect of the invention, there is provided the determination device including: a roll motor that rotates a rotating member on which the roll body is mounted, a roller that comes into contact with the medium fed from the roll body, a storage unit that stores information which is capable of specifying a pulling-out direction of the roll body mounted on the rotating member, a sensor that detects the rotation of the roller, and a determination unit that detects whether or not the roll body corresponding to the information is mounted normally. The determination unit determines that the roll body is mounted normally, in a case where the sensor does not detect the rotation of the roller, when the roll motor is rotated in a direction corresponding to the pulling-out direction which is specified based on the information stored in the storage unit.

If the roll body is mounted in the correct direction and the roll motor is rotated in the direction corresponding to the pulling-out direction, the pulled-out medium is slack between the roll body and the transportation roller, and thus the sensor does not detect the rotation of the roller. Accordingly, it is possible to determine the mounting direction of the roll body. In other words, it is possible to properly determine the mounted state of the roll body.

In addition, the present description and the accompanying drawings allows at least the aspect to become apparent. That is, according to another aspect of the invention, there is provided a printing apparatus including the determination device described above.

In this way, it is possible to properly determine the mounted state of the roll body in the printing apparatus.

In addition, the present description and the accompanying drawings allow at least the aspect to become apparent. That is, according to still another aspect of the invention, there is provided a determination method that determines a mounted state of a roll body in a medium transportation apparatus including a roll motor that rotates a rotating member on which the roll body is mounted where a medium is wound in a roll shape, a transportation roller that transports the medium fed from the roll body in a transportation direction, a storage unit that stores information which is capable of specifying a pulling-out direction of the roll body mounted on the rotating member, and a sensor that detects a rotation of the transportation roller. The determination method includes rotating the roll motor in a direction corresponding to the pulling-out direction which is specified based on the information stored in the storage unit, and determining that the roll body is not mounted normally in a case where the sensor detects the rotation of the transportation roller.

If the roll body is mounted in the correct direction and rotates the roll motor in the direction corresponding to the pulling-out direction, the pulled out medium is slack between the roll body and the transportation roller. On the other hand, when the roll body is mounted in the wrong direction and the roll motor is rotated in a direction corresponding to the pulling-out direction, the roll body rotates in the rewinding direction of the medium. Then, the medium rotates the transportation roller in the reverse direction. Accordingly, by detecting the rotating direction of the transportation roller, it is possible to determine the mounting direction of the roll body. In other words, it is possible to properly determine the mounted state of the roll body.

Embodiment

A printer 10 and a drive control method used in the embodiment will be described. The printer 10 in the embodiment is a printer which is capable of printing on a medium with a large size (for example, a printing sheet with a size of equal to or larger than A2 in JIS standard). In addition, the printer in the embodiment is an ink jet type printer. However, if such an ink jet type printer is an apparatus capable of printing by ejecting the ink, any method of ink ejection may be used in the apparatus.

Furthermore, in the description hereafter, a bottom side means a side where the printer 10 is installed and an upper side means a side separated from the side where the printer 10 is installed. In addition, a description will be made by referring to the side from which the medium is fed as a feeding side (rear end side) and the side to which the medium is ejected as a sheet discharging side (front side).

Configuration of Printer

Figure 2:
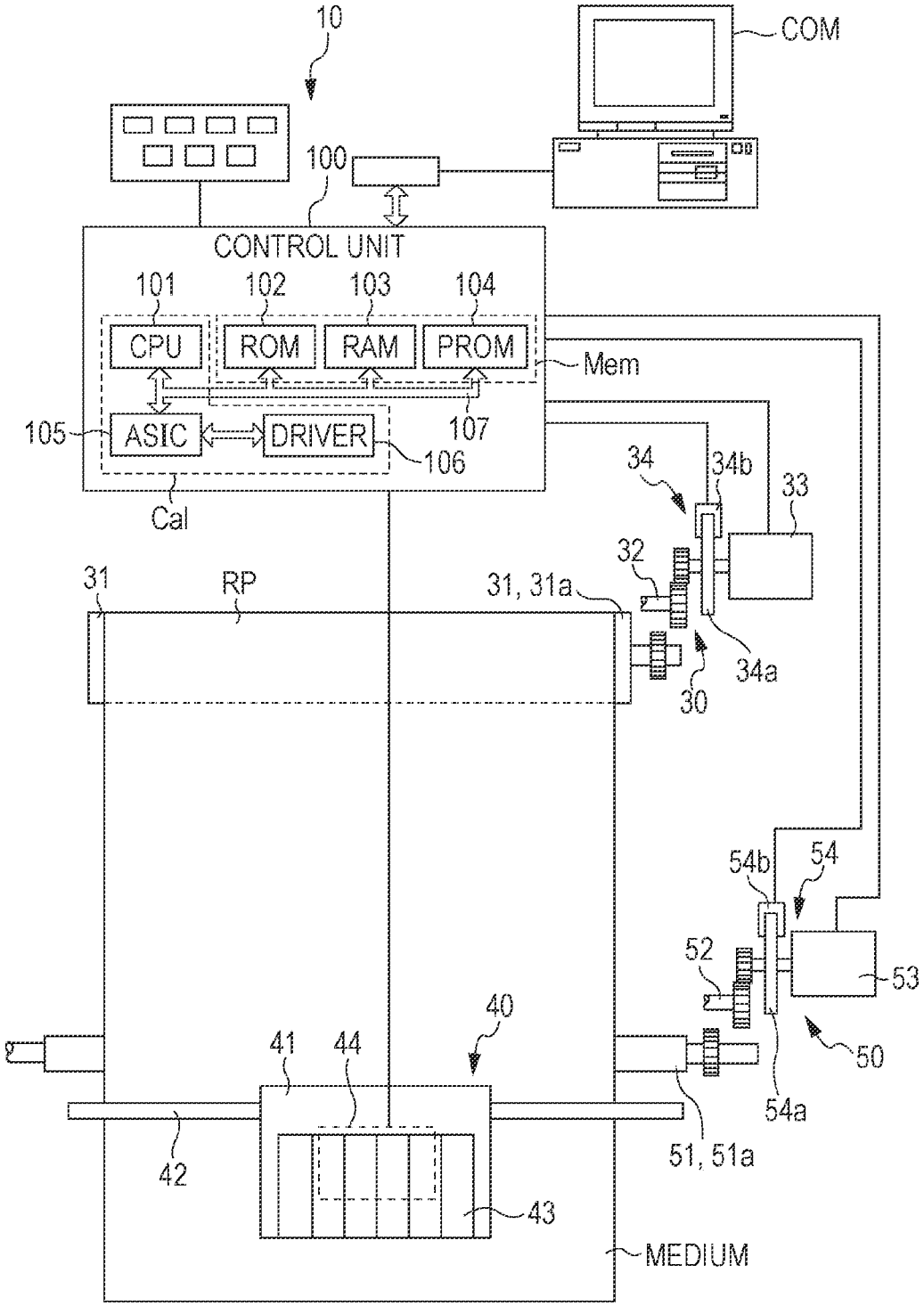
FIG. 2 is a diagram illustrating a relationship between a drive system using a DC motor and a control system in the printer in FIG. 1.
Figure 3:
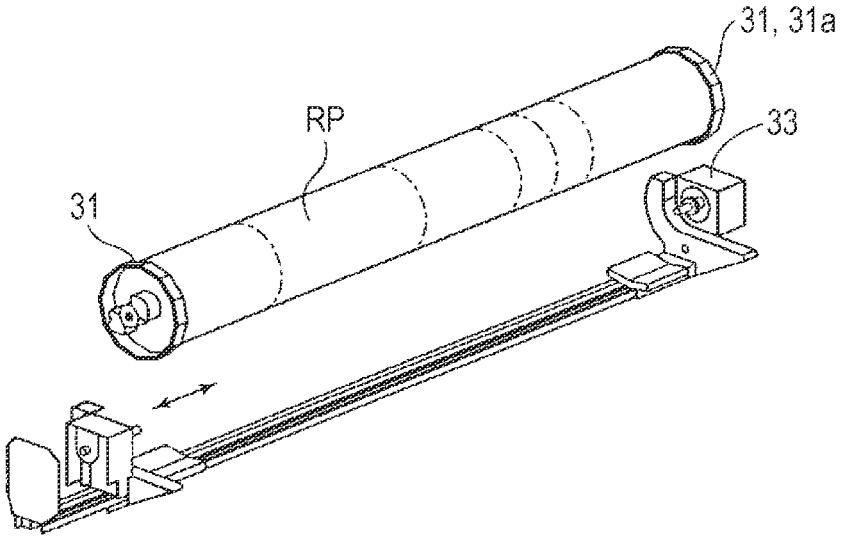
FIG. 3 is a diagram illustrating an example of an external configuration of a rotation holder and a roll motor.

FIG. 1 is a diagram illustrating an example of an external configuration of a printer 10 according to the embodiment. FIG. 2 is a diagram illustrating a relationship between a drive system having a DC motor and a control system in the printer 10 in FIG. 1. FIG. 3 is a diagram illustrating an example of external configurations of a rotation holder 31 and a roll motor 33.

In the case of this example, the printer 10 has a pair of leg units 11 and a main body unit 20 which is supported by the leg units 11. In the leg unit 11, a prop 12 is provided and freely rotatable casters 13 are attached to a caster support unit 14. In addition, a rewinding apparatus (not illustrated) which rewinds a discharged sheet P in the sheet discharging side in a roll shape, may be mounted on the prop 12.

The main body unit 20 has various devices mounted inside and is covered by an external case 21, while being supported by a chassis (not illustrated). In addition, as illustrated in FIG. 2, a roll body drive mechanism 30, a carriage drive mechanism 40 and a medium transportation mechanism 50 are provided in the main body unit 20 as a drive system using a DC motor.

The roll body drive mechanism 30 is provided on a roll mounting unit 22 present in the main body unit 20. The roll mounting unit 22, as illustrated in FIG. 1, is provided at the rear surface side and upper side of the main body unit 20, and on the inside of which a roll body RP is mounted by opening an opening and closing lid 23 which is an element configuring the external case 21 described above. The roll mounting unit 22 is capable of driving to rotate the roll body RP using the roll body drive mechanism 30.

In addition, the roll body drive mechanism 30 for rotating the roll body RP includes, as illustrated in FIGS. 2 and 3, a rotation holder 31, a gear wheel train 32, a roll motor 33 and a rotation detection unit 34. The rotation holder 31 is inserted from both end sides of a hollow hole RP1 which is provided on the roll body RP, and is provided as a pair to support the roll body RP from both end sides. The medium (for example, a sheet P) is wound on the roll body RP in a roll shape, and by the rotation of the roll body RP, a sheet P enough to be used for printing is pulled out and fed to the medium transportation mechanism 50.

The roll motor 33 provides a drive force (rotation force) via the gear wheel train 32 for a rotating holder 31*a* which is located at one end side of the pair of rotation holders 31. The roll motor 33 is capable of freely changing the rotating direction.

A rotation detection unit 34 uses a rotary encoder in the embodiment. Therefore, the rotation detection unit 34 includes a disc-shaped scale 34*a* and a rotary sensor 34*b*. The disc-shaped scale 34*a* includes a light transmitting unit which transmits light along the circumferential direction thereof in every constant interval, and a light blocking unit which blocks the light transmission. In addition, the rotary sensor 34*b* includes a light emitting element (not illustrated), a light receiving element (not illustrated) and a signal processing circuit (not illustrated) as main configuration elements. The rotation detection unit 34 in the roll body drive mechanism 30 is equivalent to a roll body rotation detection sensor.

A carriage drive mechanism 40 includes a carriage 41, a carriage shaft 42, other carriage motors (not illustrated) and a belt which are also a part of an ink supplying/ejection mechanism.

The carriage 41 includes an ink tank 43 to store various colors of ink. The ink can be supplied to the ink tank 43, via a tube (not illustrated) from an ink cartridge (not illustrated) which is fixedly provided on the front surface side of the main body unit 20. In addition, as illustrated in FIG. 2, at the bottom surface of the carriage 41, a printing head 44 which is capable of ejecting ink droplets is provided. In the printing head 44, a nozzle array (not illustrated) which corresponds to each ink is provided. On the nozzle which configures the nozzle array, piezoelectric elements are disposed. According to the operation of the piezoelectric elements, the ink droplets can be ejected from the nozzle which is located on an end portion of an ink path.

In addition, the ink feeding/ejection mechanism is configured to include the carriage 41, the ink tank 43, the printing head 44, the tube (not illustrated) and the ink cartridge (not illustrated). In addition, in the printing head 44, the method is not limited to the piezoelectric drive method using the piezoelectric element, but, for example, a heater method that utilizes the power of bubbles generated by heating the ink using a heater, a magnetostriction method using a magnetostrictor or a mist method which controls mist using an electric field may be adopted. In addition, for the ink to fill the ink cartridge/ink tank 43, any type of the ink such as a dye ink and a pigment ink may be used.

Figure 4:
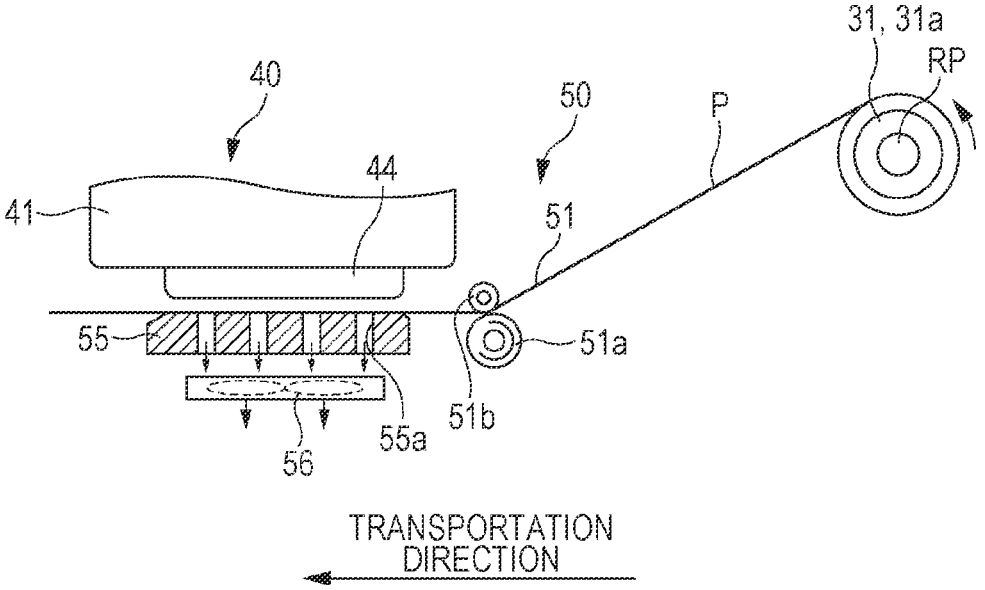
FIG. 4 is a diagram illustrating a positional relationship among a medium transported from a roll body, a transportation roller and a printing head.

FIG. 4 is a diagram illustrating a positional relationship among the sheet P transported from the roll body RP, a transportation roller 51 and the printing head 44.

The medium transportation mechanism 50, as illustrated in FIGS. 2 and 4, includes a pair of transportation rollers 51, a gear wheel train 52, a transportation motor 53 and a rotation detection unit 54. The pair of transportation rollers 51 includes a transportation roller 51*a* and a transportation driven roller 51*b*, and the medium (for example, the sheet P) drawn and transported from the roll body RP can be interposed therebetween. In addition, in the medium transportation mechanism 50 in the printer 10 in the embodiment, the sheet P is transported using the roller. However, the method in the medium transportation mechanism 50 is not limited to the method using the roller. For example, the transportation method using a belt or using a suction mechanism may be adopted.

The transportation motor 53 provides a drive force (rotation force) via the gear wheel train 52 for the transportation roller 51*a*. That is, the transportation motor 53 is equivalent to a motor providing a drive force which rotates the transportation roller 51*a*. The transportation motor 53, similar to the roll motor 33, is capable of freely changing the rotating direction. Hereafter, the rotating direction of the transportation motor 53 when the sheet P is fed in the transportation direction is referred to as a positive direction and the reverse rotating direction is referred to as a reverse direction.

The rotation detection unit 54 uses a rotary encoder in the embodiment. Therefore, the rotation detection unit 54 includes a disc-shaped scale 54*a* and a rotary sensor 54*b*. The disc-shaped scale 54*a* includes a light transmitting unit which transmits light along the circumferential direction thereof every constant interval, and a light blocking unit which blocks the light transmission. In addition, the rotary sensor 54*b* includes a light emitting element (not illustrated), a light receiving element (not illustrated) and a signal processing circuit (not illustrated) as main configuration elements. The rotation detection unit 54 in the roll body drive mechanism 50 is equivalent to a sensor that detects a rotation of the transportation driven roller 51*b*.

Figure 5A:
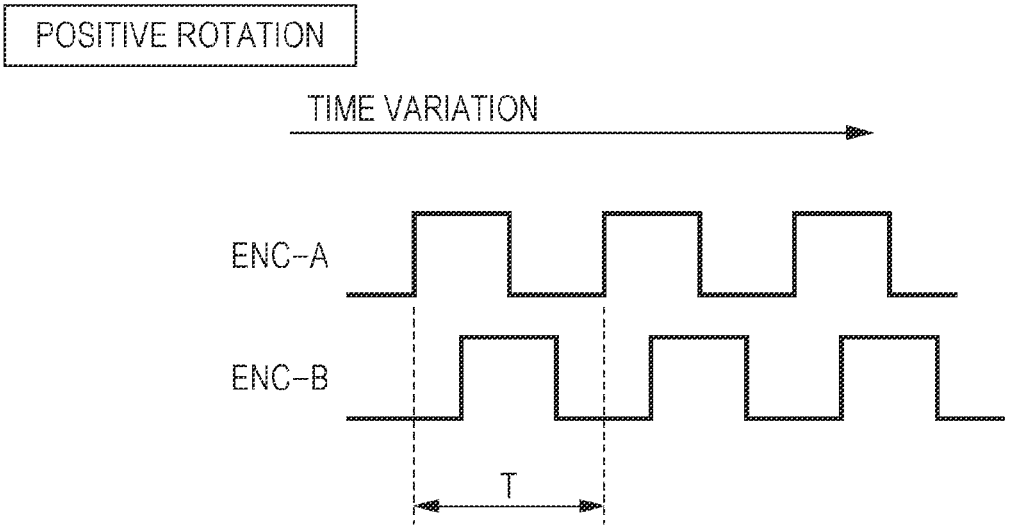
FIG. 5A is a timing chart of a waveform of an output signal when a transportation motor is in a positive rotation.
Figure 5B:
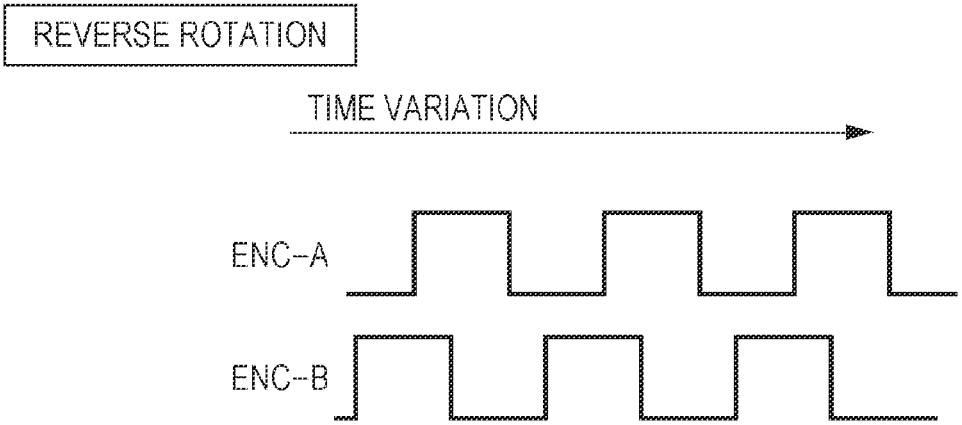
FIG. 5B is a timing chart of a waveform of the output signal when the transportation motor is in a reverse rotation.

FIG. 5A is a timing chart of a waveform of the output signal when the transportation motor 53 is in a positive rotation state. FIG. 5B is a timing chart of a waveform of an output signal when the transportation motor 53 is in a reverse rotation state. In the embodiment, by an output from the rotary sensor 54, as illustrated in FIGS. 5A and 5B, pulse signals mutually having different phases by 90 degrees (phase A ENC signal, and phase B ENC signal) are input to the control unit 100. Therefore, it is possible to detect that the transportation motor 53 is in the positive rotation state or in the reverse rotation state by reading a lead or lag of the phase.

At the further downstream side (sheet discharging side) in the transportation direction than the pair of the transportation rollers 51, a platen 55 is provided and the sheet P is guided on the platen 55 (refer to FIG. 4). In addition, the printing head 44 is disposed above the platen 55, so as to be opposed thereto. In the platen 55, suction holes 55*a* are formed. On the other hand, the suction holes 55*a*, are provided so as to communicate with a suction fan 56. By an operation of the suction fan 56, air is sucked from the printing head 44 side via the suction holes 55*a*. Accordingly, in a case where the sheet P is present on the platen 55, it is possible to suck and hold the sheet P. Furthermore, the printer 10 includes various other sensors such as a medium width detection sensor for detecting the width of the sheet P.

Control Unit

Figure 6:
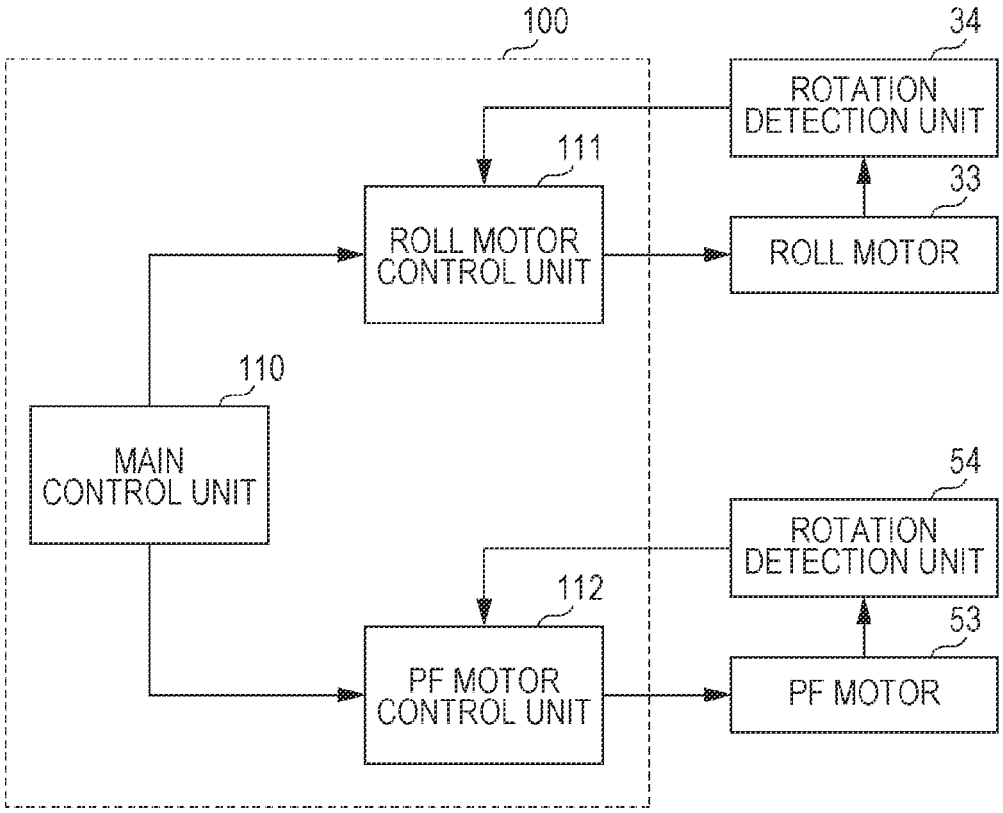
FIG. 6 is a block diagram illustrating an example of a functional configuration of a control unit in the embodiment.

FIG. 6 is a block diagram illustrating an example of a functional configuration of the control unit 100 in the embodiment. In the embodiment, an output signal from the rotation detection unit 34 of the roll body drive mechanism 30, the rotation detection unit 54 of the medium transportation mechanism 50 and a linear sensor (not illustrated), is input to the control unit 100. Additionally, each of the output signals from a sheet width detection sensor, a gap detection sensor and a power switch which turns the power ON and OFF of the printer 10 (all not illustrated), is also input to the control unit 100.

As illustrated in FIG. 2, the control unit 100 includes a CPU 101, a ROM 102, a RAM 103, a PROM 104, an ASIC 105, a motor driver 106 and the like, and those are connected to each other via a transmission path 107 such as a bus, for example. In addition, the control unit 100 is connected to a computer COM. Then, a main control unit 110, a roll motor control unit 111, a transportation motor control unit 112 are realized by a cooperation of the hardware and software and/or data stored in the ROM 102 and PROM 104, or by adding a circuit or a configuring element which performs a specific processing, as illustrated in FIG. 6.

Furthermore, the CPU 101, the ASIC 105, and the driver 106 configure a calculation unit Cal that is equivalent to the determination unit. In addition, the ROM 102, the RAM 103 and the PROM 104 configure a storage unit Mem.

The main control unit 110 controls the operations of the roll motor control unit 111 and the transportation motor control unit 112, and performs a process for transporting the sheet P in the transportation direction. The roll motor control unit 111 controls the driving of the roll motor 33 so as to feed (transport) an appropriate amount of the sheet P to the medium transportation mechanism 50 of the printer 10.

The transportation motor control unit 112 controls the driving of the transportation motor 53 based on the output signal from the rotation detection unit 54. Accordingly, the transportation motor control unit 112 controls the rotation amount of the transportation roller 51*a* and transports the sheet P in the transportation direction.

Printing Operations

When the printer 10 receives printing data from the computer COM, the control unit 100 performs a sheet feeding process, a dot forming process, a transportation process and the like by controlling each of the roll body drive mechanism 30, the carriage drive mechanism 40 and the like.

The sheet feeding process is a process that supplies the sheet P to be printed, from the roll body RP into the printer 10, and that positions the sheet at the print start position (also referred to as a cueing position). The control unit 100 rotates the roll body RP in a direction to which the sheet P is discharged and sends the sheet P to the transportation roller 51*a*. Subsequently, the control unit 100 rotates the transportation roller 51*a*, and positions the sheet sent from the roll body RP, at the print start position.

The dot forming process is a process that forms ink dots on the sheet by intermittently ejecting the ink from the printing head 44 which moves along the direction perpendicular (hereafter, also called a moving direction) to the transportation direction of the sheet P. The control unit 100 moves the carriage 41 in the moving direction and causes the printing head 44 to eject the ink based on the print data, during the movement of the carriage 41. When the ejected ink droplets land on the sheet, the dots are formed on the sheet and then a dot line formed from a plurality of dots is formed along the moving direction.

The transportation process is a process that relatively moves the sheet P along the transportation direction with respect to the head. The control unit 100 rotates the transportation roller 51*a* and transports the sheet in the transportation direction. According to the transportation process, the printing head 44 can form the dots at a different position from the position where the dots are formed by the dot forming process described above.

The control unit 100 alternately repeats the dot forming process and the transportation process until the there is no data to be printed, and gradually prints an image formed by the dot lines on the sheet. Lastly, the control unit 100 discharges the sheet which has completed the image printing.

Figure 7:
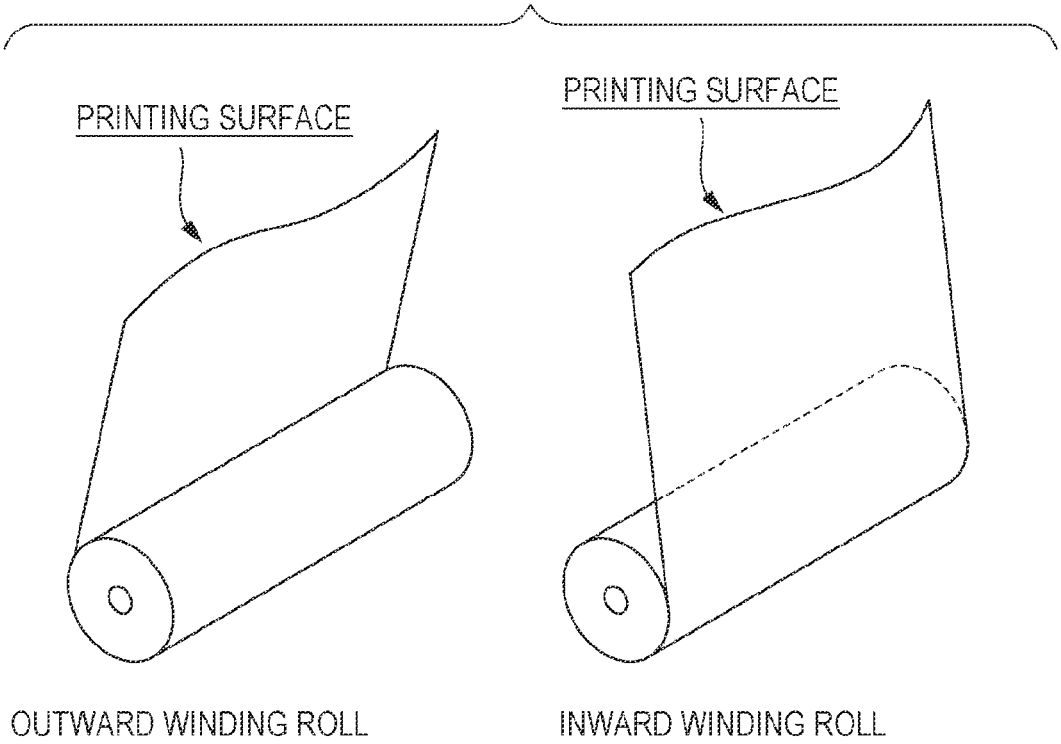
FIG. 7 is an explanatory diagram of an outward winding roll and an inward winding roll.

FIG. 7 is an explanatory diagram of an outward winding roll and an inward winding roll. The roll body RP used in the embodiment includes the outward winding roll and the inward winding roll. The outward winding roll is a roll body having a printing surface on the outer side surface of the roll body. The inward winding roll is a roll body having a printing surface on the inner side surface of the roll body.

In this way, since there are two types of roll bodies, when the roll body RP is mounted on the printer 10, setting is performed whether the outward winding roll will be used or the inward winding roll will be used. Such setting may be performed via the computer COM or may be directly performed on the printer 10. In this way, when the sheet is fed from the roll body RP, the rotation direction is determined depending on which type of the roll bodies is set to be mounted.

For example, in FIG. 4, the outward winding roll is mounted. In this case, the rotating direction when the sheet is pulled out is counterclockwise toward the plane of the sheet in FIG. 4. In this case, the outward winding roll is in the positive rotation state. In this way, the state in which the roll body RP is mounted in a direction to which the sheet P is pulled out represents a state in which the roll body RP is mounted normally.

Figure 8:
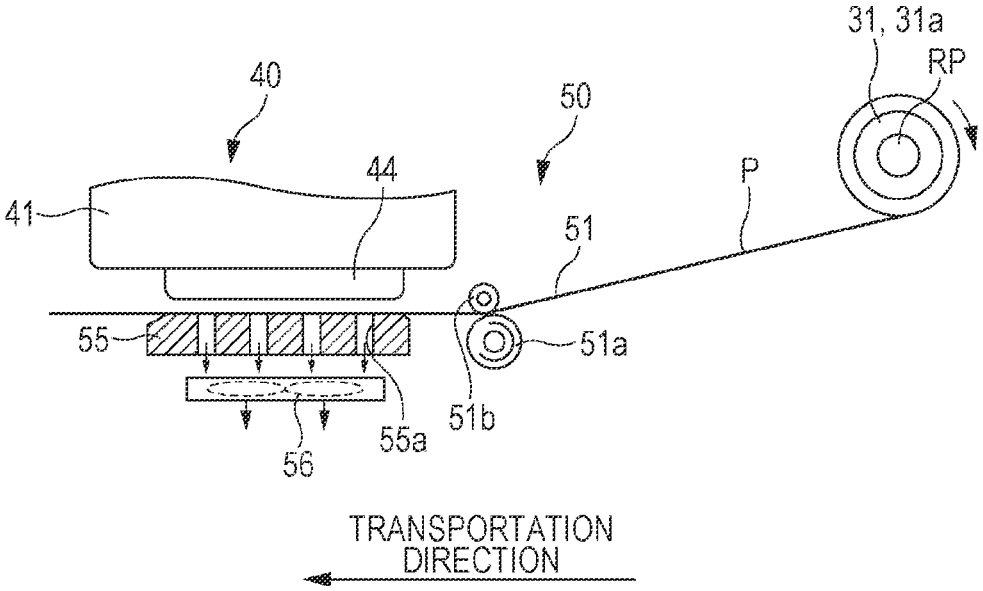
FIG. 8 is an explanatory diagram when an inward winding roll is mounted.

FIG. 8 is an explanatory diagram when the inward winding roll is mounted. In FIG. 8, since the inward winding roll is mounted, the rotation direction when the sheet P is pulled out is clockwise toward the plane of the sheet. In this case, the inward winding roll is in the positive rotation state. Also in this case, since the roll body RP is mounted in the direction to which the sheet P is pulled out, it may be considered that the roll body RP is in a normally mounted state.

In this way, in a case where there are two types of roll bodies, there is a possibility that the roll body may be mounted in the wrong direction at the time of mounting those roll bodies. For example, in a case where the outward winding roll is mounted, it is set to rotate counterclockwise as illustrated in FIG. 4, but if the outward winding roll is mistakenly mounted in a direction where the inward winding roll is mounted (that is, mounted in a direction illustrated in FIG. 8), the roll body RP does not rotate in the direction to which the sheet P is pulled out even in the positive rotation state. In this case, the roll body RP is not in the normal mounted state.

The sheet P is interposed between the pair of the transportation rollers 51 and is transported to the downstream side in the transportation direction by the transportation rollers 51. Thus, the pair of the transportation rollers 51 and the roll body RP are pulling each other.

In addition, for example, in a case where the inward winding roll is mounted, it is set to rotate clockwise as illustrated in FIG. 8, but if the inward winding roll is mistakenly mounted in a direction when the outward winding roll is mounted (that is, mounted in a direction illustrated in FIG. 4), the roll body RP does not rotate in the direction to which the sheet P is pulled out even in the positive rotation state. Also in this case, since the sheet P is interposed between the pair of the transportation rollers 51, the pair of the transportation rollers 51 and the roll body RP are pulled by each other. In this case, the roll body RP is not in a normal pulling-out direction.

In this way, in a case where there is a mistake in mounting the roll body RP, since the drive force of the roll motor 33 is much stronger than that of the transportation motor 53, there is a case where an excessive overload occurs in the transportation motor 53. In addition, in this case, the sheet P may not be properly transported and then the ink is continuously ejected onto a specific region of the sheet P, and thus there may be a case where ink accumulation occurs on the sheet P. Therefore, if there is a mistake in mounting the roll body RP, it causes a quality of image formed on the sheet P to be lowered.

Figure 9:
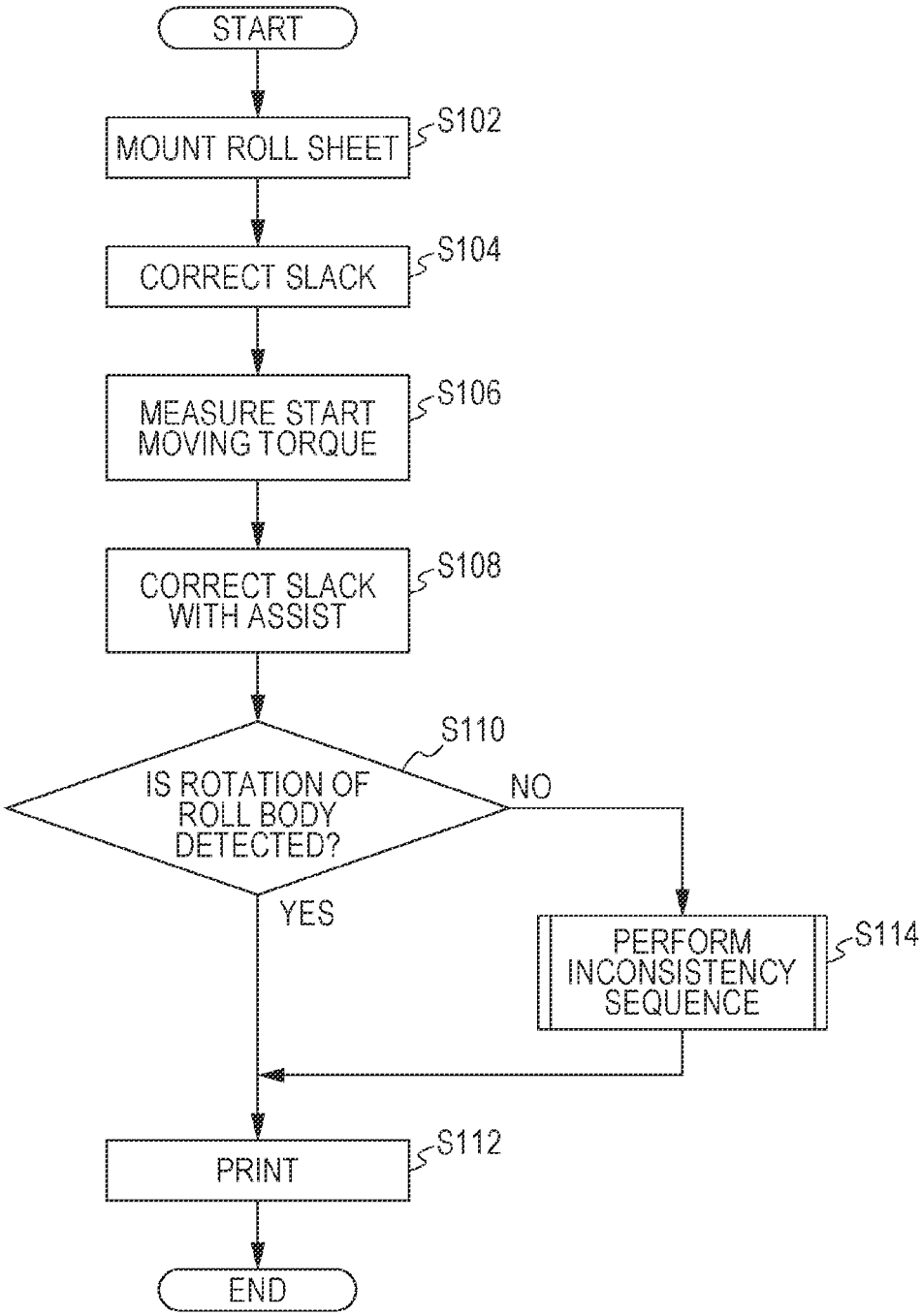
FIG. 9 is a flow chart to mount a roll sheet.
Figure 10:
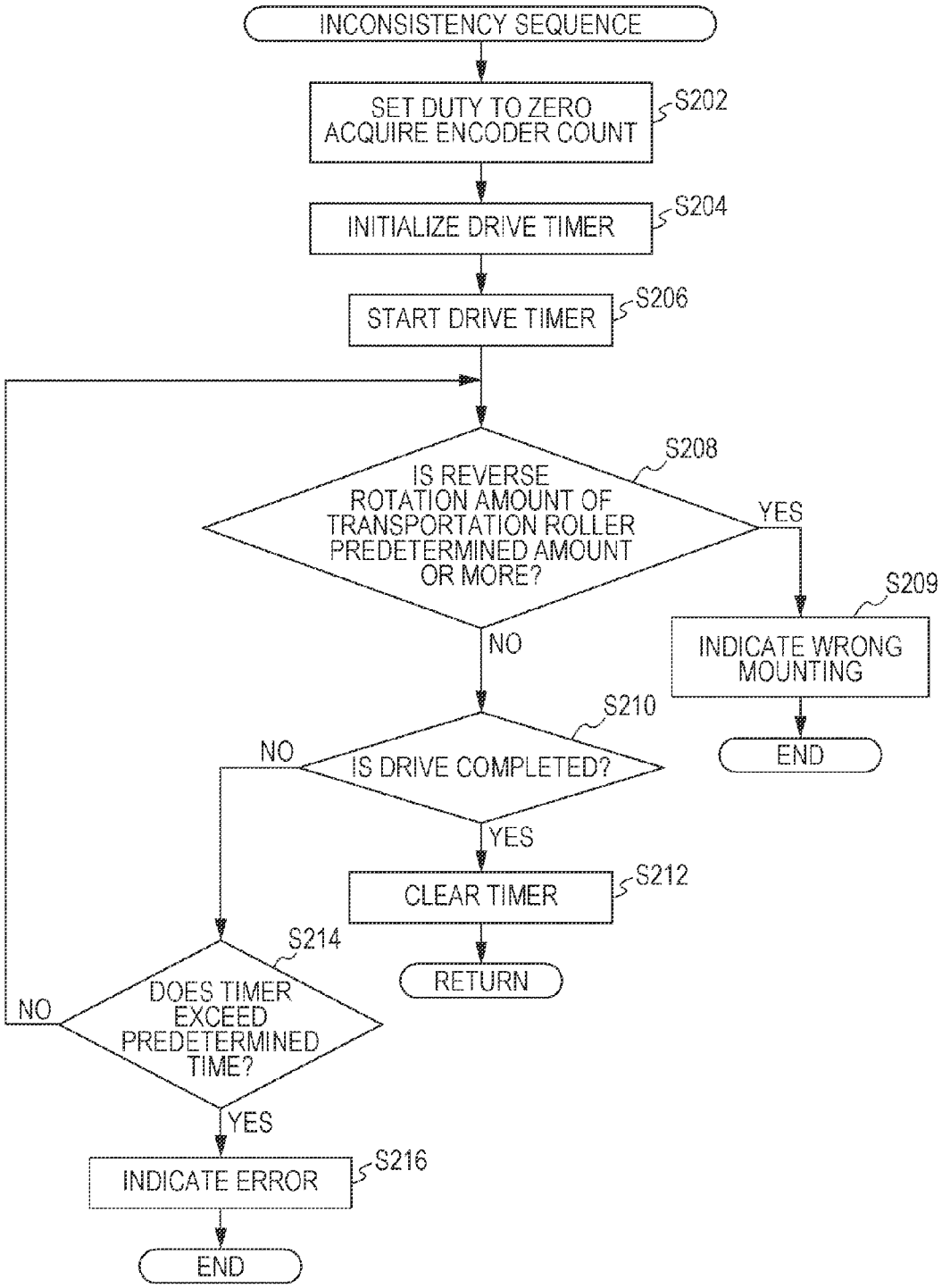
FIG. 10 is a flow chart illustrating a sequence to detect an inconsistency.

FIG. 9 is a flow chart of mounting a roll sheet. FIG. 10 is a flow chart illustrating a sequence to detect an inconsistency. Hereafter, a method of performing a determination whether or not the roll sheet is properly mounted will be described with reference to the above-described drawings.

Firstly, the roll body RP is mounted on the printer 10 (S102). Here, the description will be made assuming the case where the outward winding roll is mounted.

The roll body RP is mounted on the printer 10, the sheet P is pulled out from the roll body RP, and a leading edge of the sheet P is interposed between the pair of transportation rollers 51. In addition, in the printer 10, it is set for the roll body RP whether to mount any one between the outward winding roll and the inward winding roll. This setting is stored in the storage unit of the printer 10. Here, mounting the outward winding roll is stored. In this way, when the roll body RP is rotated in the positive direction, the printer 10 rotates the roll body RP counterclockwise as illustrated in FIG. 4.

Next, the transportation roller 51*a* is rotated in the transportation direction (S104). Then, slack in the sheet P occurring between the roll body RP and the transportation roller 51*a* is removed. Next, the roll motor 33 is driven and the measurement of a moving start torque is performed (S106). In the measurement of the moving start torque, a duty value of the roll motor 33 is gradually increased to detect the rotation of the roll body RP. The detection of rotation of the roll body is performed based on the output of the rotation detection unit 34.

The rotation direction in this case is counterclockwise as illustrated in FIG. 4 (positive rotation direction of the outward winding roll). Accordingly, in a case where the outward winding roll is mounted in a proper direction, slack in the sheet P occurs between the transportation roller 51*a* and the roll body RP.

Next, removing the slack with an assist is performed (S108). In the removing of the slack with the assist, a torque smaller than the moving start torque obtained in the measurement of the moving start torque is applied by the roll motor 33. Since the torque smaller than the moving start torque is applied, the roll body RP does not rotate in this state. However, in a case where the sheet P is transported in the transportation direction using the transportation roller 51*a*, since the rotation of the roll body RP is assisted, the roll body RP can rotate. In addition, since the roll body RP is extremely large, it is difficult to transport the sheet P only by the transportation force of the transportation roller 51*a* without any assist from the roll motor 33.

In this state, the transportation roller 51*a* is rotated by driving the transportation motor 53. Since the sheet P is transported in the sheet discharging direction by the transportation roller 51*a*, it is possible to remove the slack in the sheet P occurring between the transportation roller 51*a* and the roll body RP.

Next, the detection of the rotation of the roll body RP is performed (S110). As illustrated in S108, when the transportation roller 51*a* is rotated, in a case where the roll body RP is mounted in the correct direction, since the roll body RP is assisted to rotate by the roll motor 33, the roll body RP rotates.

Here, in a case where the rotation of the roll body RP is detected, since the slack in the sheet P is removed and the roll body RP starts to rotate, the inconsistent sequence described below is not performed, the printing process is performed (S112) as it is and the process ends.

On the other hand, in a case where the rotation of the roll body RP is not detected, the inconsistency sequence (refer to FIG. 10) is performed (S114). When the inconsistent sequence is performed, firstly, a duty value of the transportation motor 53 is set to zero to stop the rotation of the transportation roller 51*a* and a count value of a rotary encoder during the rotation stop is acquired (S202).

Next, a drive timer is initialized to be reset (S204). Then, driving the roll motor 33 is started and the drive timer is started (S206). The drive force of the roll motor 33 at this time is a sufficient drive force to rotate the roll motor 33. Accordingly, the roll motor 33 will rotate the roll body RP in the positive direction corresponding to the type of the roll body RP which is set in advance.

Next, it is determined whether or not the reverse rotation amount of the transportation roller 51*a* is equal to or larger than the predetermined amount (S208). The determination is performed based on the comparison of whether or not the difference between the current encoder count value of the transportation roller 51*a* and the encoder count value acquired in STEP S202 is equal to or larger than the predetermined value.

In a case where the reverse rotation amount is equal to or larger than the predetermined amount, the roll body RP is mounted in the mounting direction different from the direction set in the printer 10. Originally, the roll body RP should rotate so that the sheet P is pulled out, but since the mounting direction is wrong, the roll body RP is forced to rotate so that the sheet P is rewound. Since the torque of the roll motor 33 is much larger compared to the torque of the transportation motor 53, when the roll body RP rotates so that the sheet P is rewound, the transportation roller 51*a* rotates in the reverse direction due to a frictional force generated between the transportation roller 51*a* and the sheet P.

In this case, since the roll body RP is mounted in the wrong direction, the drive timer is cleared and the operation of a transportation system of the sheet P is stopped. Then an indication that the roll body RP is mounted wrong is displayed on a display unit of the printer 10 or on the computer COM. Then, the roll body RP is prompted to be mounted in the correct direction (S209).

On the other hand, in STEP S208, in a case where the reverse rotation amount is neither equal to nor larger than the predetermined amount (that is, a case where the amount is smaller than the predetermined amount), the roll body RP is mounted in the correct direction. The mounting direction is correct and thus the roll body RP rotates so as to pull out the sheet P, consequently, it is because there is no slack in the sheet P occurring between the roll body RP and the transportation roller 51*a* and the transportation roller 51*a* in the reverse direction.

In addition, in STEP S208, the determination whether or not the reverse rotation amount of the transportation roller 51*a* is equal to or larger than the predetermined amount is performed rather than only detecting the presence or absence of the reverse rotation of the transportation roller 51*a*. This is because, in a case where the transportation roller 51*a* rotates in the reverse direction but the rotation amount thereof is small, there is a possibility that the transportation roller 51*a* may be caused to rotate for some other reason. In other words, there is a possibility that the roll body RP is mounted in a correct direction. Therefore, in this case, it is to avoid the erroneous determination.

In STEP S208, in a case where the reverse rotation amount is neither equal to nor larger than the predetermined amount, a determination is performed on whether or not the drive of the roll motor 33 is completed (S210). In a case where the drive of the roll moor 33 is completed, the drive timer is cleared (S212). Then, the process returns to the flow of mounting the roll body. Then, the printing process is performed (S112) and the process ends.

On the other hand, in STEP S210, in a case where the drive of the roll motor 33 is not completed yet, a determination is performed on whether or not the timer exceeds the predetermined time (S214). Then, in a case where the drive timer indicates that it exceeds the predetermined time, the timer is reset and an error indicating that time-out is called displayed on the display unit of the printer 10 (S216). On the other hand, In STEP S214, in a case where the drive timer indicates that it does not exceed the predetermined time, the process returns to STEP S208.

In this way, it is possible to easily detect the mistake in the mounting direction of the roll body. In other words, it is possible to properly determine the method of mounting the roll body.

Other Embodiments

In the embodiment described above, the printer 10 is described as a determination device. However, it is not limited thereto. The determination device may be embodied in a liquid ejecting apparatus that ejects or discharges other fluids in addition to the ink (liquid, liquid body in which particles of the functional material are dispersed and fluid such as gel). For example, a similar technology to the above-described embodiment may be applied to a variety of apparatuses that utilizes the ink jet technology, such as an apparatus for manufacturing a color filter, a dyeing apparatus, a micro-fabrication apparatus, an apparatus for manufacturing semiconductors, a surface treatment apparatus, a three-dimensional modeling machine, a gas vaporizer, an apparatus for manufacturing an organic EL (specifically, an apparatus for manufacturing a polymer EL), an apparatus for manufacturing a display, an apparatus for film forming and an apparatus for manufacturing a DNA chip. Furthermore, an application method thereof and a method of manufacturing those apparatuses are also within the scope of the range of application.

The above-described embodiments are described for the purpose of easy understanding of the invention but not limited thereto. The invention may be modified and improved without departing from the spirit thereof and it is apparent that the equivalents thereof are included in the invention.

Head

In the embodiment described above, the ink is discharged using a piezoelectric element. However, the method for discharging liquid is not limited thereto. For example, another method such as a method of generating bubbles in a nozzle using heat may be adopted.

What is claimed is:

1. A determination device that determines a mounted state of a roll body on which a medium is wound in a roll shape, the device comprising:

a roll motor that rotates a rotating member on which the roll body is mounted;

a transportation roller that transports the medium fed from the roll body, in a transportation direction;

a storage unit that stores information which is capable of specifying a pulling-out direction of the roll body mounted on the rotating member;

a sensor that detects a rotation of the transportation roller; and a determination unit that detects whether or not the roll body corresponding to the information is mounted normally, wherein the determination unit is configured to determine that the roll body is not mounted normally, in a case where the sensor detects the reverse rotation of the transportation roller, when the roll motor is rotated in a direction corresponding to the pulling-out direction which is specified based on the information stored in the storage unit.

2. The determination device according to claim 1, wherein the determination unit determines that the roll body is not mounted normally, in a case where the sensor detects that the transportation roller rotates in a reverse direction to the rotating direction where the transportation roller transports the medium in the transportation direction, when the roll motor is driven in a direction corresponding to the pulling-out direction which is specified based on the information stored in the storage unit.

3. The determination device according to claim 2, wherein the determination unit determines that the roll body is not mounted normally, in a case where the transportation roller rotates in the reverse direction by a predetermined amount or more, when the roll motor is driven in the direction corresponding to the pulling-out direction which is specified based on the information stored in the storage unit.

4. The determination device according to claim 1, further comprising:

a transportation motor that rotates the transportation roller; and a roll body rotation detection sensor that detects a rotation of the roll body, wherein the detection unit detects a start drive force when the roll body starts rotating, by driving the roll motor to rotate the roll body after the roll body is mounted on the rotating member, and wherein the determination unit performs a determination in a case where the rotation of the roll body is not detected not to be rotating, when the transportation roller is rotated by driving the transportation motor and the roll motor using a drive force lower than the start drive force.

5. The determination unit according to claim 4, wherein the determination unit does not perform the determination in a case where the rotation of the roll body is detected, when the transportation roller is rotated by driving the transportation motor and the roll motor using the drive force lower than the start drive force.

6. The determination device according to claim 4, wherein the detection of the start drive force, which is performed by driving the roll motor, is performed after the roll body is mounted on the rotating member and then the transportation roller is rotated to generate a tensile force between the roll body and the transportation roller.

7. The determination device according to claim 4, wherein the drive force of the roll motor is higher than the drive force of the transportation motor.

8. A printing apparatus comprising:

the determination device according to claim 1.

9. A determination device that determines a mounted state of a roll body on which a medium is wound in a roll shape, the apparatus comprising:

a roll motor that rotates a rotating member on which the roll body is mounted;

a transportation roller that transports the medium fed from the roll body in a transportation direction;

a storage unit that stores information which is configured to specify a pulling-out direction of the roll body mounted on the rotating member;

a sensor that detects a rotation of the transportation roller; and a determination unit that is configured to detect whether or not the roll body corresponding to the information is mounted normally, wherein the determination unit is configured to determine that the roll body is mounted normally, in a case where the sensor does not detect that the reverse rotation of the transportation roller, when the roll motor is rotated in a direction corresponding to the pulling-out direction which is specified based on the information stored in the storage unit.

* * * * *